US011724918B2

(12) United States Patent
Nagao

(10) Patent No.: US 11,724,918 B2
(45) Date of Patent: Aug. 15, 2023

(54) METHOD OF RENEWING PASSENGER CONVEYOR

(71) Applicant: Mitsubishi Electric Corporation, Tokyo (JP)

(72) Inventor: Yukiyasu Nagao, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 18 days.

(21) Appl. No.: 17/606,458

(22) PCT Filed: Aug. 6, 2019

(86) PCT No.: PCT/JP2019/030830
§ 371 (c)(1),
(2) Date: Oct. 26, 2021

(87) PCT Pub. No.: WO2021/024368
PCT Pub. Date: Feb. 11, 2021

(65) Prior Publication Data

US 2022/0194745 A1 Jun. 23, 2022

(51) Int. Cl.
*B66B 25/00* (2006.01)
*B66B 23/00* (2006.01)
*B66B 29/00* (2006.01)

(52) U.S. Cl.
CPC ..... *B66B 25/006* (2013.01); *B66B 23/00* (2013.01); *B66B 29/00* (2013.01)

(58) Field of Classification Search
CPC ..... B66B 25/006; B66B 23/00; B66B 29/00; B66B 21/02; B66B 21/10; B66B 2201/00; B66B 2201/46; G06F 8/60; G06F 8/65
See application file for complete search history.

(56) References Cited

U.S. PATENT DOCUMENTS 5,936,200 A * 8/1999 Park ..... H01R 4/26 174/59
6,267,219 B1 * 7/2001 Spannhake ..... B66B 29/005 198/322

FOREIGN PATENT DOCUMENTS

| | | | |
|---|---|---|---|
| GB | 2121748 | A | 1/1984 |
| JP | 58-193880 | A | 11/1983 |
| JP | 2002-104759 | A | 4/2002 |
| JP | 2003327382 | A * | 11/2003 |
| JP | 2004-10190 | A | 1/2004 |

(Continued)

OTHER PUBLICATIONS

International Search Report and Written Opinion dated Oct. 8, 2019, received for PCT Application PCT/JP2019/030830, Filed on Aug. 6, 2019, 10 pages including English Translation.

*Primary Examiner* — Gene O Crawford
*Assistant Examiner* — Abby A Jorgensen
(74) *Attorney, Agent, or Firm* — Xsensus LLP

(57) ABSTRACT

There is provided a method of renewing a passenger conveyor that is capable of preventing the passenger conveyor from being unavailable for a long time period when the passenger conveyor is renewed in a stepped manner. The method of renewing a passenger conveyor includes a safety device update process of updating an existing safety device to a new safety device in the passenger conveyor, and a drive machine and control panel update process of, after the safety device update process, updating an existing drive machine of the passenger conveyor to a new drive machine and updating an existing control panel of the passenger conveyor to a new control panel.

11 Claims, 7 Drawing Sheets

(56) References Cited

FOREIGN PATENT DOCUMENTS

| | | | | |
|---|---|---|---|---|
| JP | 2004-323153 | A | | 11/2004 |
| JP | 2007-119167 | A | | 5/2007 |
| JP | 2008044684 | A | * | 2/2008 |
| JP | 2015-809 | A | | 1/2015 |
| JP | 2018-95328 | A | | 6/2018 |

* cited by examiner

METHOD OF RENEWING PASSENGER CONVEYOR

CROSS-REFERENCE TO RELATED APPLICATION

The present application is based on PCT filing PCT/JP2019/030830, filed Aug. 6, 2019, the entire contents of which are incorporated herein by reference.

FIELD

The present invention relates to a method of renewing a passenger conveyor.

BACKGROUND

PTL 1 discloses a method of renewing a passenger conveyor. According to the renewing method, the passenger conveyor can be renewed in a stepped manner.

CITATION LIST

Patent Literature

[PTL 1] JP 2004-323153 A

SUMMARY

Technical Problem

However, in a second process of the method of renewing a passenger conveyor disclosed in PTL 1, it is necessary to update a safety device and a control panel. This causes the passenger conveyor to be unavailable for a long time period.

The present invention has been made to solve the above-described problem. An object of the present invention is to provide a method of renewing a passenger conveyor that is capable of preventing the passenger conveyor from being unavailable for a long time period when the passenger conveyor is renewed in a stepped manner.

Solution to Problem

A method of renewing a passenger conveyor according to the present invention includes a safety device update process of updating an existing safety device to a new safety device in a passenger conveyor, and a drive machine and control panel update process of, after the safety device update process, updating an existing drive machine of the passenger conveyor to a new drive machine and updating an existing control panel of the passenger conveyor to a new control panel.

Advantageous Effects of Invention

According to the present invention, a process of renewing a passenger conveyor is divided into a safety device update process and a drive machine and control panel update process. This can prevent the passenger conveyor from being unavailable for a long time period when the passenger conveyor is renewed in a stepped manner.

DESCRIPTION OF EMBODIMENTS

Figure 1:
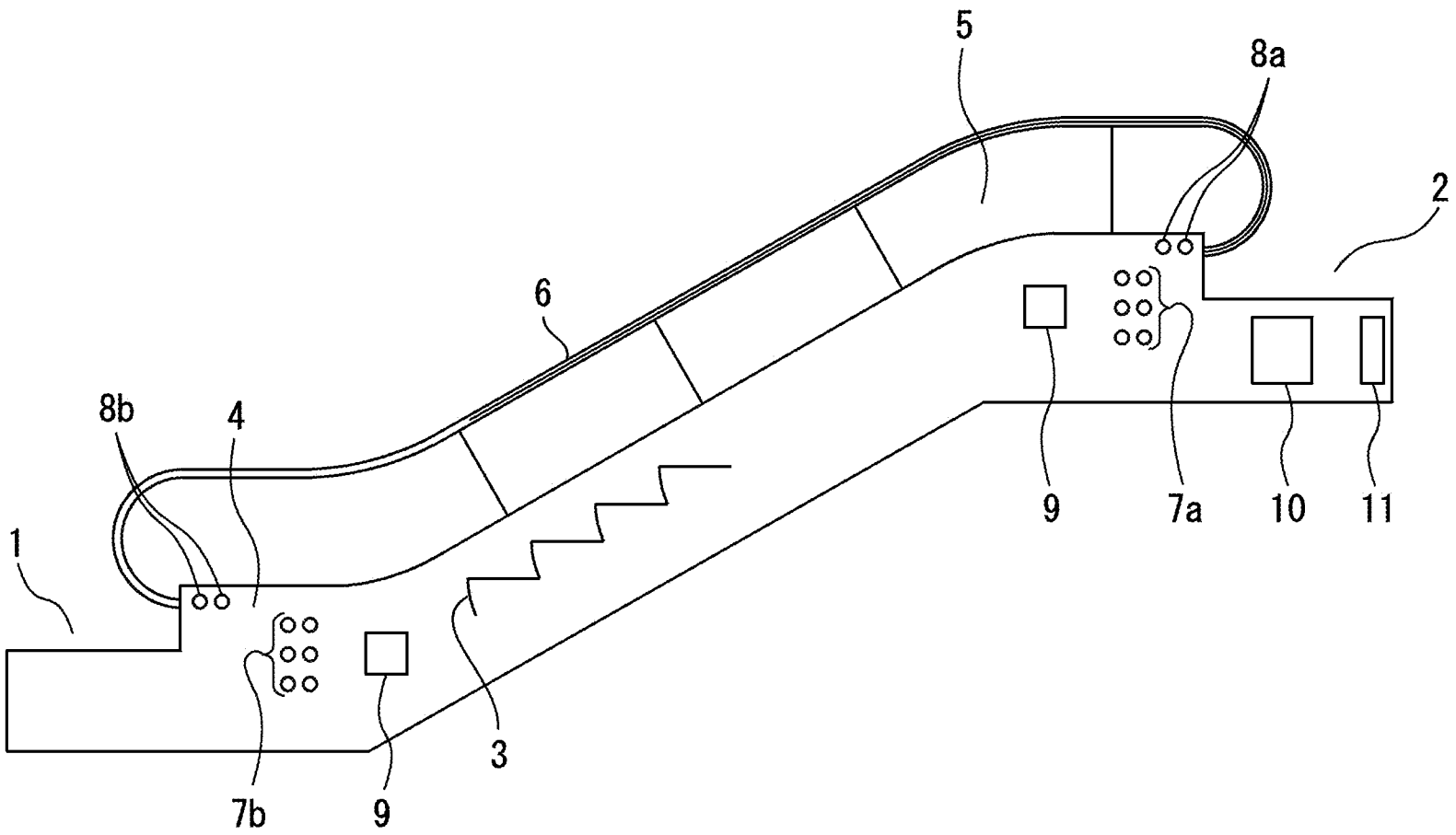
FIG. 1 is a structural diagram of a passenger conveyor to which a method of renewing a passenger conveyor according to Embodiment 1 is applied.

Embodiments of the present invention will be described with reference to the accompanying drawings. Note that in the drawings, parts that are identical or correspond to each other are assigned with the same reference numeral. Overlapping description of such parts will be simplified or omitted as appropriate.

Embodiment 1

FIG. 1 is a structural diagram of a passenger conveyor to which a method of renewing a passenger conveyor according to Embodiment 1 is applied.

The passenger conveyor in FIG. 1 is an escalator. For example, the passenger conveyor is installed across one to the other of adjacent floors.

A lower platform 1 is provided at a lower portion of the passenger conveyor. The lower platform 1 is provided on a lower one of the adjacent floors. An upper platform 2 is provided at an upper portion of the passenger conveyor. The upper platform 2 is provided on an upper one of the adjacent floors.

A plurality of steps 3 are provided between the lower platform 1 and the upper platform 2. The plurality of steps 3 are formed in an endless shape.

One of a pair of skirt guards 4 is provided outside one side of the plurality of steps 3. The other one of the pair of skirt guards 4 is provided outside the other side of the plurality of steps 3. Each of the pair of skirt guards 4 extends in a longitudinal direction of the passenger conveyor.

Each of a pair of balustrade panels 5 is provided to the corresponding one of the pair of skirt guards 4. Each of the pair of balustrade panels 5 extends in the longitudinal direction of the passenger conveyor.

Each of a pair of hand rails 6 is provided to the corresponding one of the pair of balustrade panels 5. Each of the pair of hand rails 6 is formed in an endless shape.

A plurality of existing safety devices 7*a* are provided at the upper portion of the passenger conveyor. The plurality of existing safety devices 7*a* are configured to be capable of detecting a mechanical abnormality or a state of a user of the passenger conveyor. A plurality of existing operation panels 8*a* are provided at the upper portion of the passenger conveyor. The plurality of existing operation panels 8*a* are configured to be capable of stopping the operation of the passenger conveyor when being operated. One of a plurality of existing connection boxes 9 is provided at the upper portion of the passenger conveyor.

A plurality of existing safety devices 7*b* are provided at the lower portion of the passenger conveyor. The plurality of existing safety devices 7*b* are configured to be capable of detecting a mechanical abnormality or a state of a user of the passenger conveyor. A plurality of existing operation panels 8*b* are provided at the lower portion of the passenger conveyor. The plurality of existing operation panels 8*b* are configured to be capable of stopping the operation of the passenger conveyor when being operated. The other of the plurality of existing connection boxes 9 is provided at the lower portion of the passenger conveyor.

An existing drive machine 10 is provided at the upper portion of the passenger conveyor. An existing control panel 11 is provided at the upper portion of the passenger conveyor.

The existing control panel 11 connects the operation of the passenger conveyor as a whole. For example, the existing control panel 11 controls the operation of the existing drive machine 10 based on signals from the plurality of existing safety devices 7*a*, the plurality of existing safety devices 7*b*, the plurality of existing operation panels 8*a*, and the plurality of existing operation panels 8*b*.

For example, when the passenger conveyor performs an operation of moving upward by control of the existing control panel 11, the lower platform 1 serves as an entrance, and the upper platform 2 serves as an exit. The exposed steps 3 move from the lower platform 1 in the horizontal direction. Then, the exposed steps 3 move obliquely upward. Then, the exposed steps 3 move in the horizontal direction toward the upper platform 2. At this time, each of the hand rails 6 moves in a circulating manner along with a circulating movement of the plurality of steps 3.

For example, when the passenger conveyor performs an operation of moving downward by control of the existing control panel 11, the upper platform 2 serves as an entrance, and the lower platform 1 serves as an exit. The exposed steps 3 move from the upper platform 2 in the horizontal direction. Then, the exposed steps 3 move obliquely downward. Then, the exposed steps 3 move in the horizontal direction toward the lower platform 1. At this time, each of the hand rails 6 moves in a circulating manner along with a circulating movement of the plurality of steps 3.

Next, the method of renewing a passenger conveyor will be described in detail with reference to FIGS. 2 to 6.

FIGS. 2 to 6 each are a connection diagram of the passenger conveyor to which the method of renewing a passenger conveyor according to Embodiment 1 is applied.

Figure 2:
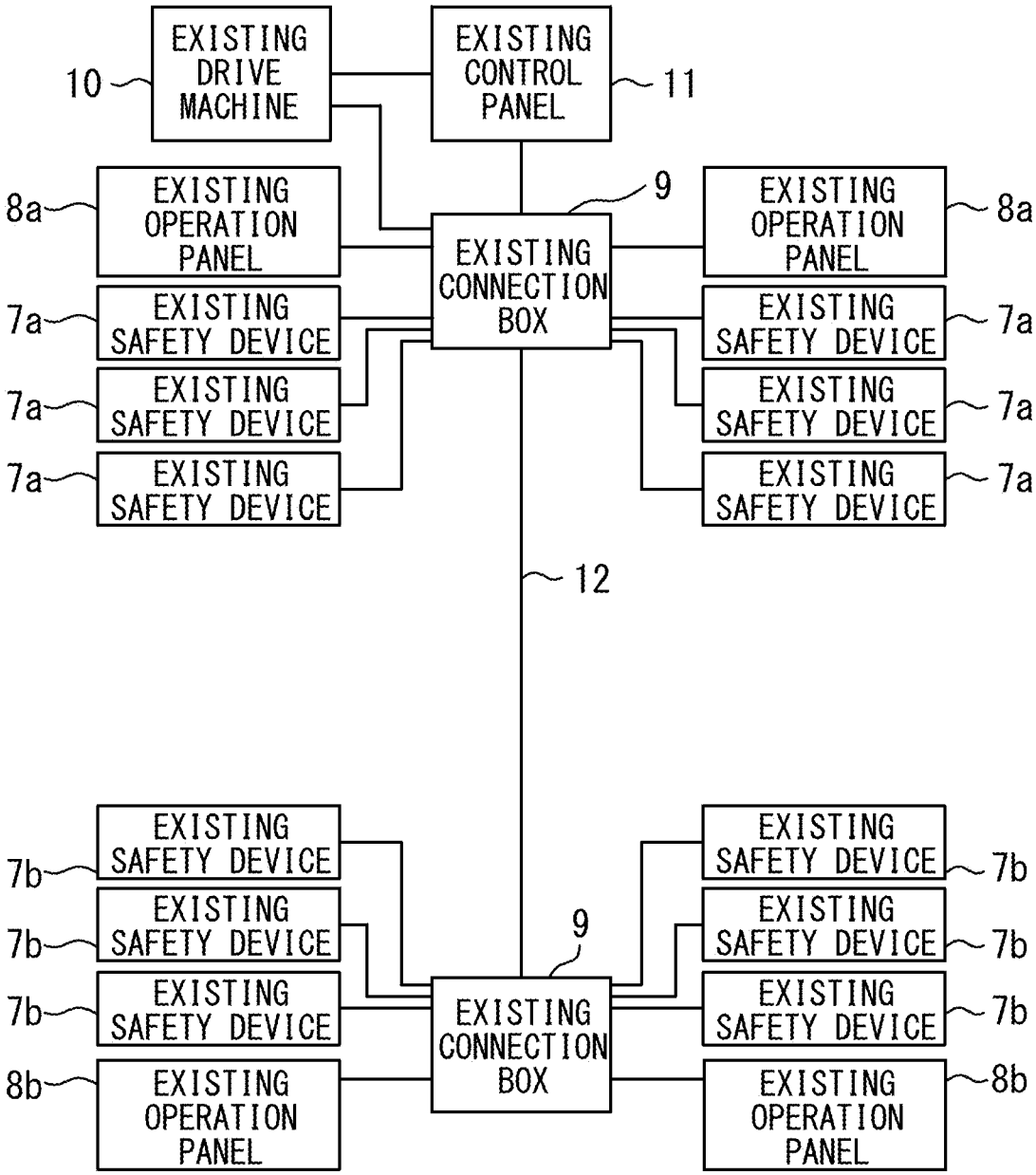
FIG. 2 is a connection diagram of the passenger conveyor to which the method of renewing a passenger conveyor according to Embodiment 1 is applied.

As illustrated in FIG. 2, a plurality of devices of the passenger conveyor are electrically connected to one another via cables. For example, one and the other of the plurality of existing connection boxes 9 are electrically connected to each other via an existing relay cable 12.

Figure 3:
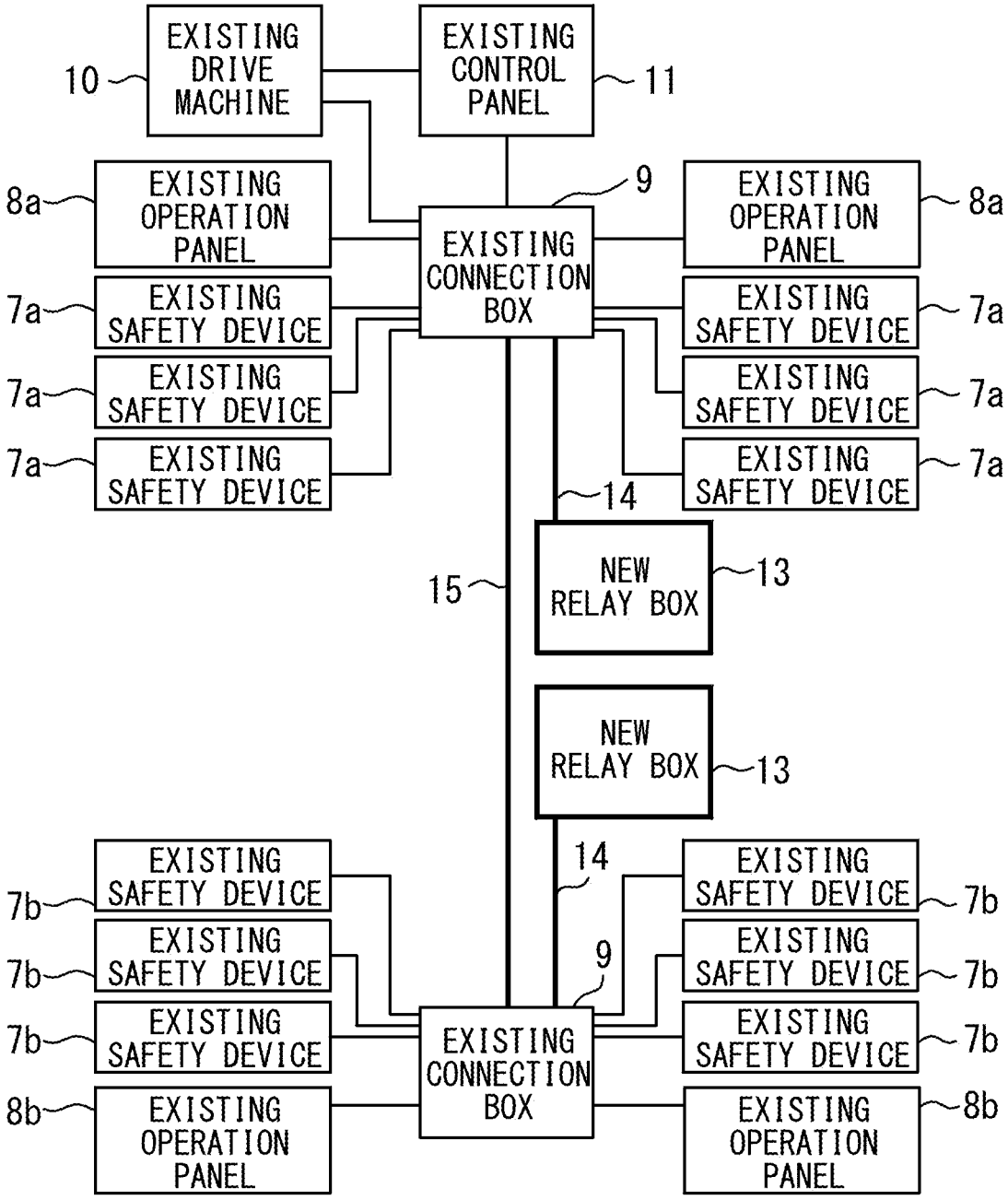
FIG. 3 is a connection diagram of the passenger conveyor to which the method of renewing a passenger conveyor according to Embodiment 1 is applied.

FIG. 3 is a connection diagram after a relay box connection process is performed. In the relay box connection process, a worker installs one of a plurality of new relay boxes 13 inside and at an upper portion of a frame of the passenger conveyor. The worker installs the other of the plurality of new relay boxes 13 inside and at a lower portion of the frame of the passenger conveyor.

The worker places one of a plurality of new cables 14 inside and at the upper portion of the passenger conveyor. The worker electrically connects one of the plurality of new relay boxes 13 and one of the plurality of existing connection boxes 9 via one of the plurality of new cables 14. The worker places the other of the plurality of new cables 14 inside and at the lower portion of the passenger conveyor. The worker electrically connects the other of the plurality of new relay boxes 13 and the other of the plurality of existing connection boxes 9 via the other of the plurality of new cables 14.

The worker releases the existing relay cable 12 (not illustrated in FIG. 3) from the electrical connection with the plurality of existing connection boxes 9. The worker electrically connects one and the other of the plurality of existing connection boxes 9 via a new relay cable 15.

Figure 4:
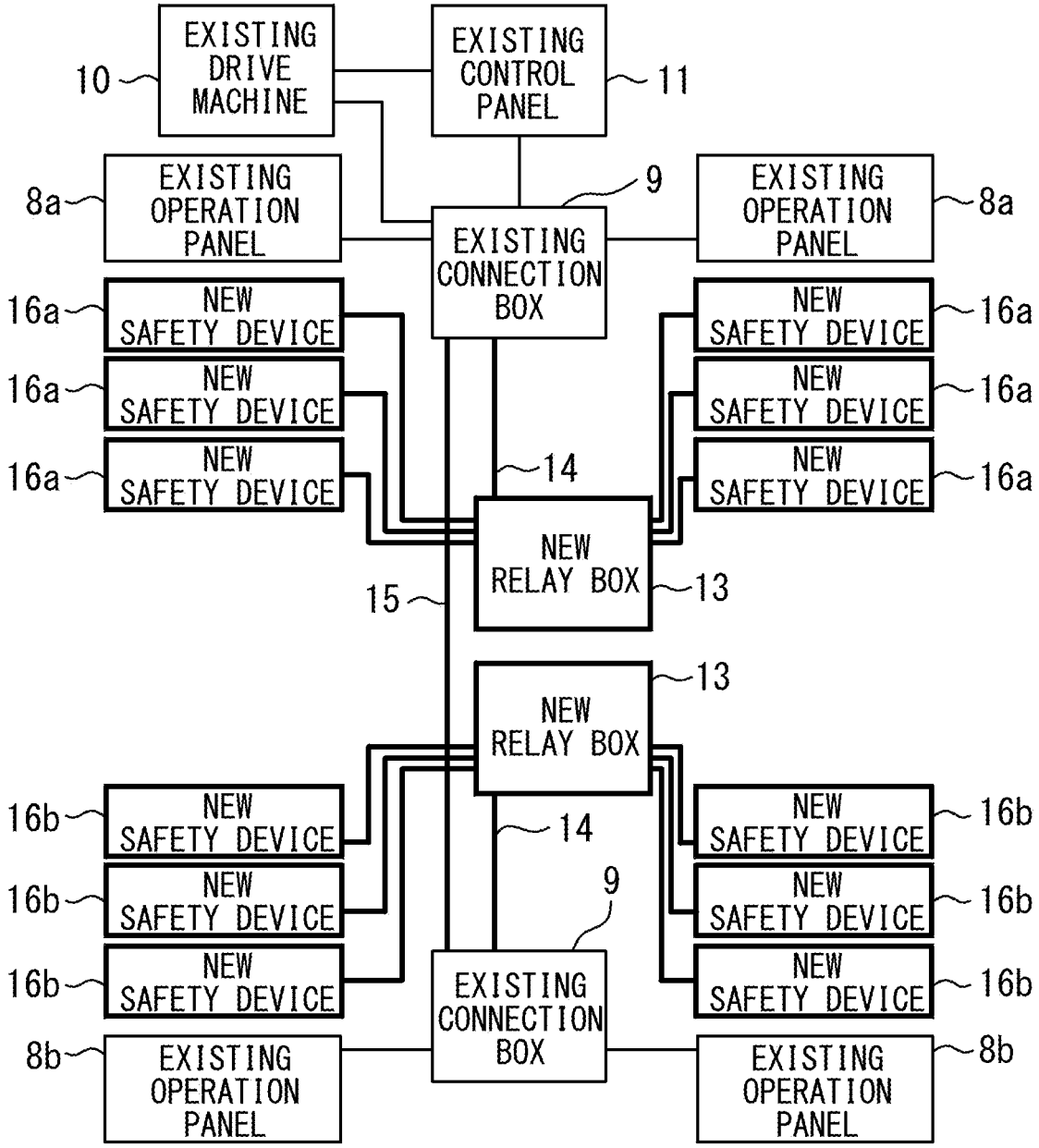
FIG. 4 is a connection diagram of the passenger conveyor to which the method of renewing a passenger conveyor according to Embodiment 1 is applied.

FIG. 4 is a connection diagram after a safety device update process is performed. In the safety device update process, the worker releases the plurality of existing safety devices 7*a* (not illustrated in FIG. 4) from the electrical connection with one of the plurality of existing connection boxes 9. The worker electrically connects a plurality of new safety devices 16*a* to one of the plurality of new relay boxes 13. The worker releases the plurality of existing safety devices 7*b* (not illustrated in FIG. 4) from the electrical connection with the other of the plurality of existing connection boxes 9. The worker electrically connects a plurality of new safety devices 16*b* to the other of the plurality of new relay boxes 13.

Figure 5:
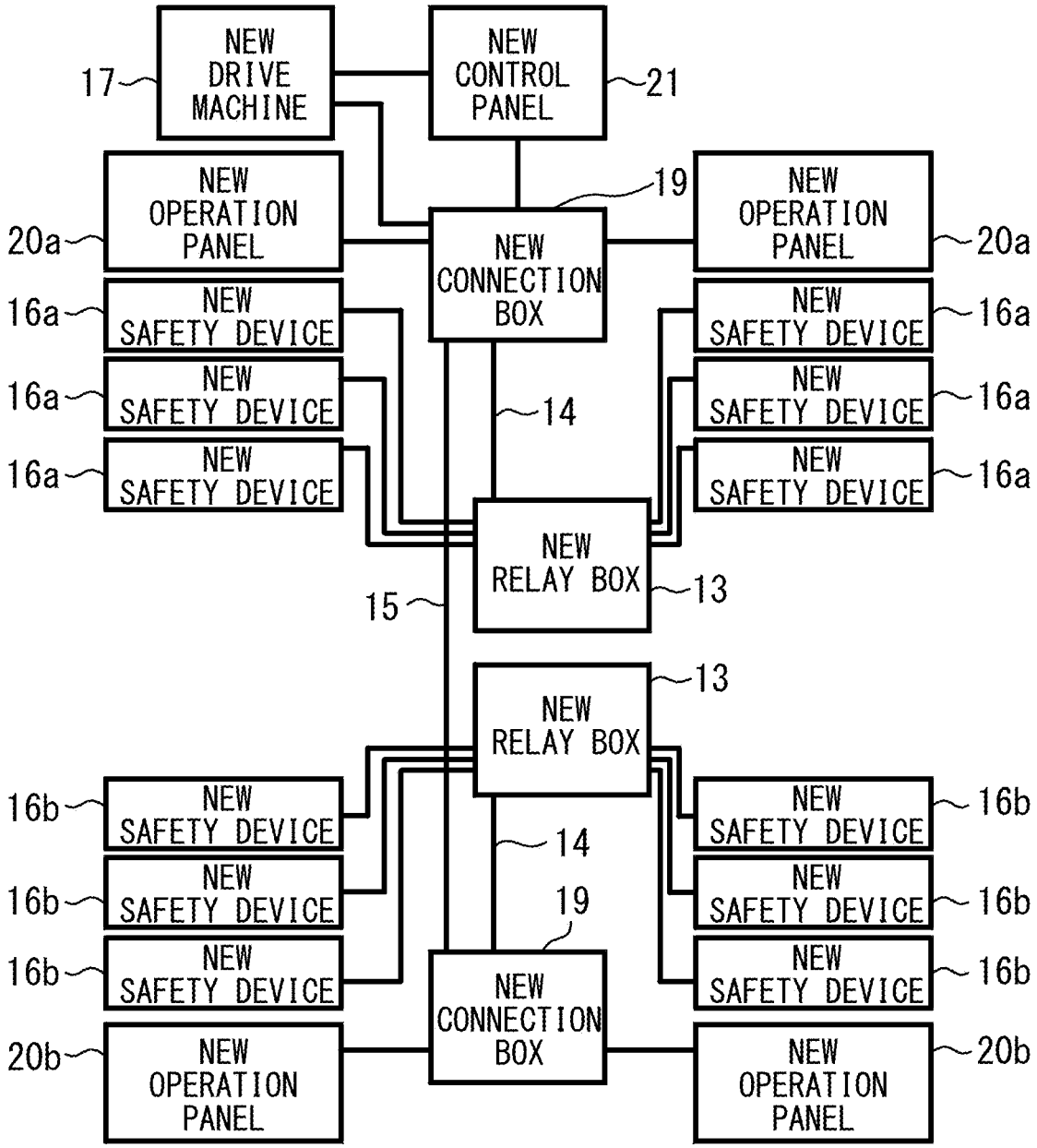
FIG. 5 is a connection diagram of the passenger conveyor to which the method of renewing a passenger conveyor according to Embodiment 1 is applied.

FIG. 5 is a connection diagram after a drive machine and control panel update process is performed. In the drive machine and control panel update process, the worker releases the existing drive machine 10 (not illustrated in FIG. 5) from the electrical connection of one of the plurality of existing connection boxes 9 and the existing control panel 11.

The worker releases the existing control panel 11 (not illustrated in FIG. 5) from the electrical connection with one of the plurality of existing connection boxes 9. The worker releases the plurality of existing operation panels 8*a* (not illustrated in FIG. 5) from the electrical connection with one of the plurality of existing connection boxes 9 (not illustrated in FIG. 5). The worker releases the plurality of existing operation panels 8*b* (not illustrated in FIG. 5) from the electrical connection with the other of the plurality of existing connection boxes 9 (not illustrated in FIG. 5).

The worker electrically connects one of a plurality of new connection boxes 19 to one of the plurality of new relay boxes 13. The worker electrically connects a new drive machine 17 to one of the plurality of new connection boxes 19. The worker electrically connects a plurality of new operation panel 20*a* to one of the plurality of new connection boxes 19. The worker electrically connects a new control panel 21 to the new drive machine 17 and one of the plurality of new connection boxes 19.

The worker electrically connects the other of the plurality of new connection boxes 19 to the other of the plurality of new relay boxes 13. The worker electrically connects a plurality of new operation panel 20*b* to the other of the plurality of new connection boxes 19. Note that within the drive machine and control panel update process, the existing drive machine 10, the existing control panel 11, the existing connection boxes 9, the existing operation panels 8*a*, and the existing operation panels 8*b* may be released in any order. Furthermore, within the drive machine and control panel update process, the new drive machine 17, the new control panel 21, the new connection boxes 19, the new operation panels 20*a*, and the new operation panels 20*b* may be connected in any order.

Next, a procedure of the method of renewing a passenger conveyor will be described with reference to FIG. 6.

Figure 6:
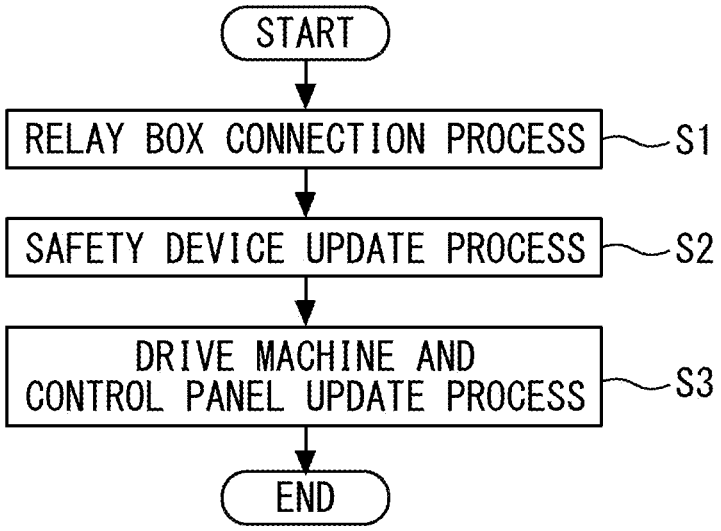
FIG. 6 is a flowchart illustrating a procedure of the method of renewing a passenger conveyor according to Embodiment 1.

FIG. 6 is a flowchart illustrating the procedure of the method of renewing a passenger conveyor according to Embodiment 1.

In step S1, the worker performs the relay box connection process. Then, the worker performs a process of step S2. In step S2, the worker performs the safety device update process. Then, the worker performs a process of step S3. In step S3, the worker performs the drive machine and control panel update process. Then, the renewal of the passenger conveyor is completed.

According to Embodiment 1 described above, the process of renewing the passenger conveyor is divided into the safety device update process and the drive machine and control panel update process. Therefore, a work of renewing the passenger conveyor is subdivided. As a result, the passenger conveyor can be prevented from being unavailable for a long time period when the passenger conveyor is renewed in a stepped manner.

At this time, work contents can be determined according to a work available time for each day when the passenger conveyor is renewed. Therefore, in a plan of work schedule in which the passenger conveyor is renewed, the flexibility can be improved.

For example, in the relay box connection process, the existing devices in the drive control portion are not changed. Therefore, at the time of completion of each work, the normal operation of the passenger conveyor may be performed by control of the existing control panel 11.

For example, one of the plurality of existing safety devices 7*a* may be released from the electrical connection with one of the plurality of existing connection boxes 9 by disconnecting one cable from the plurality of existing safety devices 7*a*, so that one of the plurality of new safety devices 16*a* is electrically connected to one of the plurality of new relay boxes 13. Also in this case, the normal operation of the passenger conveyor may be performed by control of the existing control panel 11.

The work of renewing the passenger conveyor is performed at the upper portion and lower portion of the passenger conveyor. Therefore, the worker at the upper portion of the passenger conveyor and the worker at the lower portion of the passenger conveyor can simultaneously perform the work. As a result, the passenger conveyor can be surely prevented from being unavailable for a long time period.

In the drive machine and control panel update process, the existing drive machine 10 and the existing control panel 11 are updated to the new drive machine 17 and the new control panel 21 in the same process. As a result, as compared with the case where the drive machine is updated first in a renewing method in which the drive machine and the control panel are updated in separate processes, a new interface panel is not required, which is required when the new drive machine 17 is controlled by the existing control panel 11. Accordingly, this can reduce the work required for renewing the passenger conveyor. Furthermore, this can reduce costs required for renewing the passenger conveyor.

In the drive machine and control panel update process, the existing drive machine 10 and the existing control panel 11 are updated to the new drive machine 17 and the new control panel 21 in the same process. As a result, a temporary control panel having a function of the above-described new interface panel does not need to be temporarily connected to the new drive machine 17. Accordingly, this can reduce the work required for renewing the passenger conveyor. Furthermore, this can reduce costs required for renewing the passenger conveyor.

In the drive machine and control panel update process, the existing drive machine 10 and the existing control panel 11 are updated to the new drive machine 17 and the new control panel 21 in the same process. As a result, as compared with the case where the control panel is updated first in the renewing method in which the drive machine and the control panel are updated in separate processes, both of a control function of the existing drive machine 10 and a control function of the new drive machine 17 do not need to be provided to the new control panel 21. Accordingly, this can reduce the work required for renewing the passenger conveyor. Furthermore, this can reduce costs required for renewing the passenger conveyor.

Embodiment 2

Figure 7:
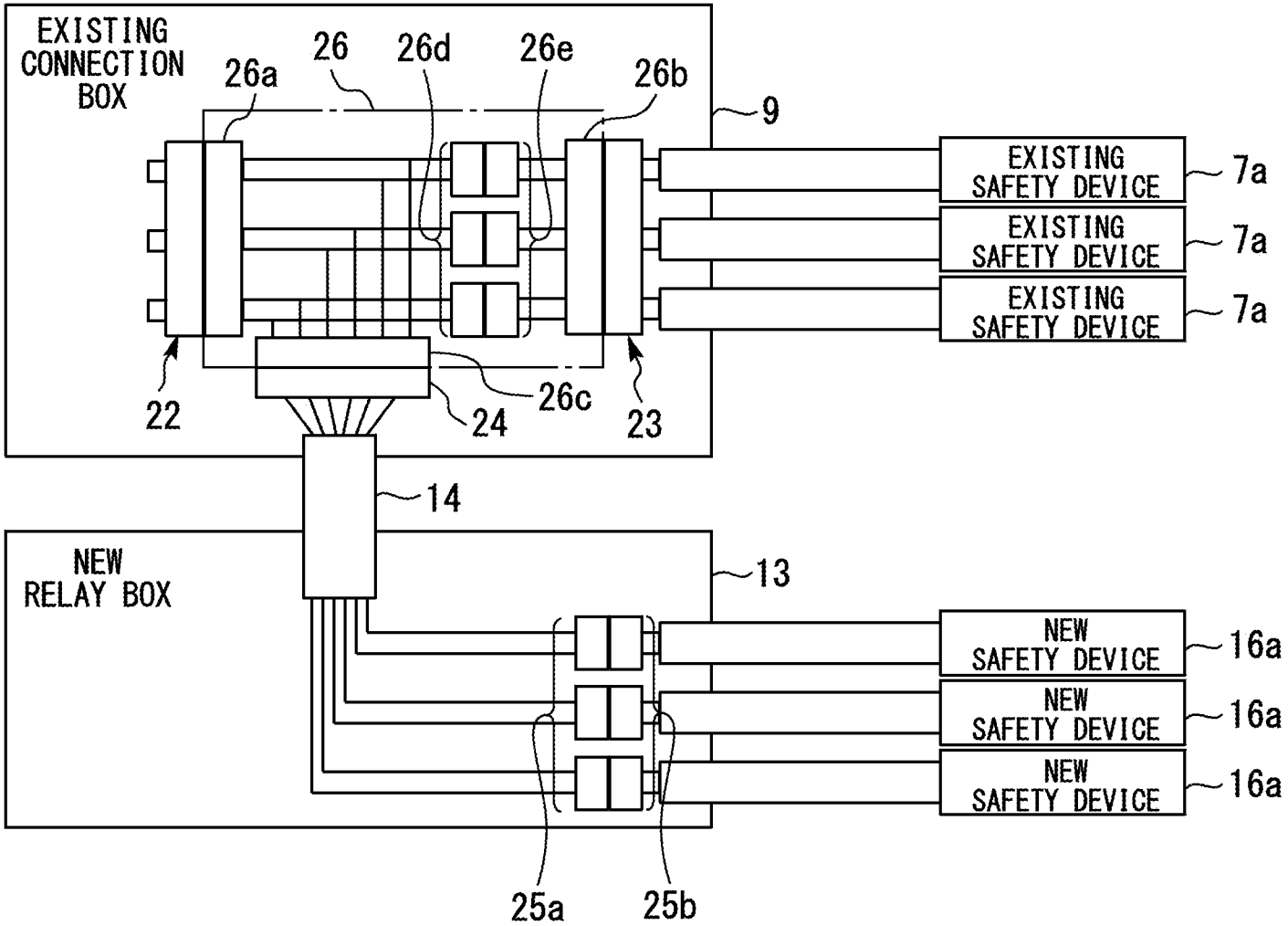
FIG. 7 is a connection diagram of a passenger conveyor to which a method of renewing a passenger conveyor according to Embodiment 2 is applied.

FIG. 7 is a connection diagram of a passenger conveyor to which a method of renewing a passenger conveyor according to Embodiment 2 is applied. Note that parts that are identical or correspond to parts in Embodiment 1 are assigned with the same reference numeral. Description of such parts will be omitted.

In FIG. 7, an existing connection box-side connector 22 is provided in the existing connection box 9. The existing connection box-side connector 22 is mechanically and electrically connected in a detachable manner to a plurality of connectors corresponding to the plurality of existing operation panels 8*a* (not illustrated in FIG. 7). The existing connection box-side connector 22 is mechanically and electrically connected in a detachable manner to a connector corresponding to the existing drive machine 10 (not illustrated in FIG. 7). The existing connection box-side connector 22 is mechanically and electrically connected in a detachable manner to a connector corresponding to the existing control panel 11 (not illustrated in FIG. 7).

An existing safety device-side connector 23 is electrically connected to the plurality of cables corresponding to the plurality of new safety devices 16*a* existing safety devices 7*a*.

A new cable-side connector 24 is electrically connected to one end of the new cable 14.

Each of a plurality of first new safety device-side connectors 25*a* is electrically connected to the other end of the new cable 14. Each of a plurality of second new safety device-side connectors 25*b* is electrically connected to a corresponding one of the plurality of cables connected in one-to-one correspondence with the plurality of new safety devices 16*a*. Each of the plurality of second new safety device-side connectors 25*b* is mechanically and electrically connected in a detachable manner to the corresponding one of the plurality of first new safety device-side connectors 25*a*.

A new adaptor 26 includes a first connection portion 26*a*, a second connection portion 26*b*, a third connection portion 26*c*, a plurality of first release connectors 26*d*, and a plurality of second release connector 26*e*.

The first connection portion 26*a* is provided to be capable of being mechanically and electrically connected in a detachable manner to the existing connection box-side connector 22. The second connection portion 26*b* is provided to be capable of being mechanically and electrically connected in a detachable manner to the existing safety device-side connector 23. The third connection portion 26*c* is electrically connected to the first connection portion 26*a*. The third connection portion 26*c* is provided to be capable of being mechanically and electrically connected in a detachable manner to the new cable-side connector 24.

The plurality of first release connectors 26*d* is provided in one-to-one correspondence with the plurality of existing safety devices 7*a*. Each of the plurality of first release connectors 26*d* is electrically connected to the first connection portion 26*a* and the third connection portion 26*c*. Each of the plurality of second release connectors 26*e* is electrically connected to the second connection portion 26*b*. Each of the plurality of second release connectors 26*e* is provided to be capable of being mechanically and electrically connected in a detachable manner to the corresponding one of the plurality of first release connectors 26*d*.

Before the relay box connection process, the existing connection box-side connector 22 and the existing safety device-side connector 23 are mechanically and electrically connected to each other. As a result, the plurality of existing safety devices 7*a* maintain an operable state.

In the relay box connection process, the existing connection box-side connector 22 and the existing safety device-side connector 23 are released from the mechanical and electrical connection. Then, the first connection portion 26*a* of the new adaptor 26 is mechanically and electrically connected to the existing connection box-side connector 22. The second connection portion 26*b* of the new adaptor 26 is mechanically and electrically connected to the existing safety device-side connector 23. The plurality of first release connectors 26*d* are mechanically and electrically connected in one-to-one correspondence with the plurality of second release connectors 26*e*. As a result, the plurality of existing safety devices 7*a* maintain an operable state.

Then, the existing safety device-side connector 23 and the second connection portion 26*b* of the new adaptor 26 are released from the mechanical and electrical connection. Then, the third connection portion 26*c* of the new adaptor 26 is mechanically and electrically connected to the new cable-side connector 24. As a result, the plurality of new safety devices 16*a* maintain an operable state.

According to Embodiment 2 described above, the existing connection box 9 and the new cable 14 are mechanically and electrically connected to each other via the new adaptor 26. Therefore, the existing connection box 9 and the new cable 14 can be easily connected to each other.

Note that in the new adaptor 26, each of the plurality of existing safety devices 7*a* may be independently released from the electrical connection with the new cable 14. For example, any one of the plurality of first release connectors 26*d* may be released from the mechanical and electrical connection with any one of the plurality of second release connectors 26*e*, and only the corresponding first new safety device-side connector 25*a* and second new safety device-side connector 25*b* may be mechanically and electrically connected to each other. In this case, any one of the plurality of existing safety devices 7*a* is updated to any one of the plurality of new safety devices 16*a*. Even in this state, the normal operation of the passenger conveyor may be performed. As a result, the work of renewing the passenger conveyor can be efficiently performed.

The similar new adaptor 26 may be applied to the plurality of existing safety devices 7*b* and the plurality of new safety devices 16*b*. Also in this case, the existing connection box 9 and the new cable 14 can be easily connected.

Note that the method of renewing a passenger conveyor according to Embodiment 1 or Embodiment 2 may be applied to a moving walkway. Also in this case, the moving walkway can be prevented from being unavailable for a long time period when the moving walkway is renewed in a stepped manner.

INDUSTRIAL APPLICABILITY

As described above, the method of renewing a passenger conveyor according to the present invention can be used for a passenger conveyor.

REFERENCE SIGNS LIST

1 Lower platform
2 Upper platform
3 Step
4 Skirt guard
5 Balustrade panel
6 Hand rail
7*a* Existing safety device
7*b* Existing safety device
8*a* Existing operation panel
8*b* Existing operation panel
9 Existing connection box
10 Existing drive machine
11 Existing control panel
12 Existing relay cable
13 New relay box
14 New cable
15 New relay cable
16*a* New safety device
16*b* New safety device
17 New drive machine
19 New connection box
20*a* New operation panel
20*b* New operation panel
21 New control panel
22 Existing connection box-side connector
23 Existing safety device-side connector
24 New cable-side connector
25*a* First new safety device-side connector
25*b* Second new safety device-side connector
26 New adaptor
26*a* First connection portion
26*b* Second connection portion
26*c* Third connection portion
26*d* First release connector
26*e* Second release connector

The invention claimed is:

1. A method of renewing a passenger conveyor, comprising:

a relay box connection process of electrically connecting a new relay box and an existing connection box electrically connected to an existing safety device in a passenger conveyor;

a safety device update process of releasing the existing safety device from an electrical connection with the existing connection box, electrically connecting a new safety device to the new relay box, and updating the existing safety device to the new safety device in the passenger conveyor; and a drive machine and control panel update process of, after the safety device update process, updating an existing drive machine of the passenger conveyor to a new drive machine and updating an existing control panel of the passenger conveyor to a new control panel.

2. The method of renewing a passenger conveyor according to claim 1, wherein the drive machine and control panel update process comprises a process of, after the safety device update process, releasing the existing drive machine from an electrical connection of the existing connection box and the existing control panel, releasing the existing control panel from an electrical connection with the existing connection box, electrically connecting a new connection box to the new relay box, electrically connecting the new drive machine to the new connection box, and electrically connecting the new control panel to the new drive machine and the new connection box.

3. The method of renewing a passenger conveyor according to claim 1, wherein the drive machine and control panel update process comprises a process of, after the safety device update process, releasing the existing control panel from an electrical connection of the existing connection box and the existing drive machine, releasing the existing drive machine from an electrical connection with the existing connection box, electrically connecting a new connection box to the new relay box, electrically connecting the new control panel to the new connection box, and electrically connecting the new drive machine to the new control panel and the new connection box.

4. The method of renewing a passenger conveyor according to claim 2, wherein the existing safety device is included in a plurality of existing safety devices, the new safety device is included in a plurality of new safety devices, and the safety device update process comprises a process of maintaining the passenger conveyor in an operable state by the existing control panel, by releasing one of the plurality of existing safety devices from the electrical connection with the existing connection box and electrically connecting one of the plurality of new safety devices to the new relay box.

5. The method of renewing a passenger conveyor according to claim 2, wherein the new relay box is included in a plurality of new relay boxes, the existing connection box is included in a plurality of existing connection boxes, and the relay box connection process comprises a process of electrically connecting one of the plurality of new relay boxes and one of the plurality of existing connection boxes via one of a plurality of new cables in an upper portion of the passenger conveyor and electrically connecting another of the plurality of new relay boxes and another of the plurality of existing connection boxes via another of the plurality of new cables in a lower portion of the passenger conveyor.

6. The method of renewing a passenger conveyor according to claim 5, wherein the relay box connection process comprises a process of electrically connecting a new adaptor and a connector electrically connected to the existing connection box and the existing safety device and electrically connecting the new adaptor and the one of the plurality of new cables.

7. The method of renewing a passenger conveyor according to claim 6, wherein the existing safety device is included in a plurality of existing safety devices, and the relay box connection process comprises a process of independently releasing each of the plurality of existing safety devices from an electrical connection with the one of the plurality of new cables in the new adaptor.

8. The method of renewing a passenger conveyor according to claim 3, wherein the existing safety device is included in a plurality of existing safety devices, the new safety device is included in a plurality of new safety devices, and the safety device update process comprises a process of maintaining the passenger conveyor in an operable state by the existing control panel, by releasing one of the plurality of existing safety devices from the electrical connection with the existing connection box and electrically connecting one of the plurality of new safety devices to the new relay box.

9. The method of renewing a passenger conveyor according to claim 3, wherein the new relay box is included in a plurality of new relay boxes, the existing connection box is included in a plurality of existing connection boxes, and the relay box connection process comprises a process of electrically connecting one of the plurality of new relay boxes and one of the plurality of existing connection boxes via one of a plurality of new cables in an upper portion of the passenger conveyor and electrically connecting another of the plurality of new relay boxes and another of the plurality of existing connection boxes via another of the plurality of new cables in a lower portion of the passenger conveyor.

10. The method of renewing a passenger conveyor according to claim 9, wherein the relay box connection process comprises a process of electrically connecting a new adaptor and a connector electrically connected to the existing connection box and the existing safety device and electrically connecting the new adaptor and the one of the plurality of new cables.

11. The method of renewing a passenger conveyor according to claim 10, wherein the existing safety device is included in a plurality of existing safety devices, and the relay box connection process comprises a process of independently releasing each of the plurality of existing safety devices from an electrical connection with the one of the plurality of new cables in the new adaptor.

* * * * *